US005897465A

United States Patent [19]

Hautamaki

[11] Patent Number: 5,897,465

[45] Date of Patent: Apr. 27, 1999

[54] MARTIAL ARTS PRACTICE DEVICE HAVING AN IMPROVED MECHANISM FOR MOUNTING STRIKING PADS

[76] Inventor: Jeffrey L. Hautamaki, N3032 E. Little Green Rd., Markesan, Wis. 53946-8825

[21] Appl. No.: 08/934,465

[22] Filed: Sep. 19, 1997

[51] Int. Cl.[6] ..... A63B 26/00

[52] U.S. Cl. ..... 482/83; 482/87

[58] Field of Search ..... 482/83–90, 121; 473/441, 442–445

[56] References Cited

U.S. PATENT DOCUMENTS

| | | | |
|---|---|---|---|
| D. 356,127 | 3/1995 | Mara | D21/191 |
| 2,253,758 | 8/1941 | Bulloch | 482/83 |
| 2,606,755 | 8/1952 | Samuels | 482/83 |
| 2,967,709 | 1/1961 | Stahley | 473/441 |
| 3,427,021 | 2/1969 | Donato . | |
| 3,782,724 | 1/1974 | Rottman et al. | 273/55 |
| 3,958,801 | 5/1976 | Correa . | |
| 4,209,168 | 6/1980 | Partlow | 482/83 |
| 4,565,366 | 1/1986 | Struss . | |
| 5,046,724 | 9/1991 | Sotomayer . | |
| 5,183,451 | 2/1993 | Hautamaki | 482/86 |
| 5,221,243 | 6/1993 | Walker | 482/83 |
| 5,261,821 | 11/1993 | Shic | 434/247 |
| 5,458,552 | 10/1995 | Mara | 482/90 |
| 5,472,395 | 12/1995 | Trocchio | 482/83 |
| 5,536,229 | 7/1996 | Albergo | 482/83 |

*Primary Examiner*—Jerome W. Donnelly
*Attorney, Agent, or Firm*—Godfrey & Kahn, S.C.

[57] ABSTRACT

A martial arts practice device that includes a standard and a means for supporting the standard in a substantially vertical position. The invention provides a system of inter-fastened pads to mount a striking pad to the standard. The standard has a front side and two lateral sides. An elongated pad is positioned on the standard so that its two longitudinally oriented cushions cover the two lateral sides of the standard. The two longitudinally oriented cushions define an opening through which the front side of the standard is accessible. Several protective pads are mounted to the longitudinally oriented cushions to cover the opening and fix the elongated pad to the standard. At least one striking-pad plate is mounted on the standard and each such plate is used to mount a striking pad to the standard. The striking-pad plate has a fitting for receiving a flexible member. Each striking pad has a central bore with a fabric collar around the top of the central bore. The striking pad is inserted through the central opening of a rim pad and the fabric collar is fastened to a ring-shaped fastening means on the rim pad. The striking pad is slid over the flexible member so that the flexible member is inserted into the striking pad's central bore and the rim pad is fastened to the longitudinally oriented cushions of the elongated pads, thereby fastening the striking pad to the standard.

18 Claims, 5 Drawing Sheets

MARTIAL ARTS PRACTICE DEVICE HAVING AN IMPROVED MECHANISM FOR MOUNTING STRIKING PADS

FIELD OF THE INVENTION

The present invention relates to exercise devices. More particularly, the present invention relates to a martial arts practice device designed with a plurality of positionable striking pads.

BACKGROUND OF THE INVENTION

Exercise devices are used for various reasons including improving the skills and techniques needed to perform various athletic and physical movements. In the field of martial arts, a number of devices have been developed to help those learning a martial art improve and hone their ability to execute specific physical movements such as kicks, punches, and blocks. One such device is disclosed in U.S. Pat. No. 5,183,451 (the "'451 patent"). The device shown in the '451 patent includes a plurality of striking pads which are attached to an upright support. Each of the pads includes a cylindrically shaped, flexible pad member which is secured over a pintl which, in turn, is attached to a moveable spring. The spring is positioned within an aperture formed in a truncated, conically-shaped base plate which is fastened to the upright by threaded fasteners.

The pads in the device shown in the '451 patent are designed to be struck by an individual who is practicing a martial-arts movement. Normally, the pads are oriented perpendicular to the upright. When a pad is struck, it is deflected to a position askew from the original position. Specifically, the pad member moves over the truncated, conically-shaped base late in response to being hit. After a strike, the spring-mounted pintl causes the pad to return to its original position, with the pad moving back to a substantially perpendicular position with respect to the upright. Thus, the device may be used to execute numerous repetitions of a specific movement with the striking pad moving back to substantially the same point after each repetition.

While the device shown in the '451 patent is useful, it does suffer from several shortcomings. In particular, the mechanism used to attach the striking pads to the upright is unduly complex and includes numerous components. This makes the device relatively expensive to manufacture and maintain. For example, manufacturing a conically-shaped base plate for the mounting assembly requires relatively sophisticated manufacturing facilities which, of course, increase the overall price of the practice device. Further, each spring used to connect a striking pad to the upright is subject to wear and stretching, which reduces its resiliency and ultimately necessitates that it be replaced when it becomes worn out.

Another device used to practice martial arts is shown in U.S. Pat. No. 5,458,552 (the "'552 patent"). This device includes an upright support having a plurality of flexible, focus target pads releasably secured to it. This device also has drawbacks. First, the devices requires relatively complex assemblies to mount each of the target pads to the upright. Second, while designing a device to have a releasable target pad may be useful in some instances, training that requires high numbers of repetitions can not be accomplished with this device, as the pads are likely to fly off the upright support after they are struck.

Therefore, it would be desirable to have a martial arts practice device that may be used to practice specific physical movements by having a user strike a target or pad. Further, it would be desirable to have a device designed with target or striking pads that return to a predetermined position after being struck, so that 1) a high number of repetitions of a movement can be executed and 2) complex movements resulting in multiple blows or strikes to the same point or position can be practiced. Further still, it would be desirable to have a device that is relatively simple and inexpensive to build.

OBJECTS AND SUMMARY OF THE INVENTION

Therefore, it is an object of the present invention to provide a martial arts practice device having a number of striking or target pads which are resiliently mounted to the device in a relatively simple manner.

It is another object of the present invention to provide a martial arts practice device that can be used to perform a high number of repetitions of the same movement.

It is another object of the present invention to provide a martial arts practice device that can be used to practice relatively complex martial arts movements that require multiple blows or strikes to the same point or position.

A further object of the present invention is to provide a martial arts device that is configured in such a manner as to lessen the probability that a user will inadvertently strike a relatively rigid component of the device and also lessen the impact to the user if he or she should strike such a component of the device.

These and other objects are achieved in a martial arts practice device that includes a stanchion or standard and a means for supporting the standard in a substantially vertical position. In one embodiment, the means for supporting the standard includes a base plate which is adapted to be positioned on a flat surface and the standard is mounted on the base plate. The standard is further secured in its vertical position by one or more braces that are affixed to the standard and the base plate.

The standard may be any post, beam, tube, or similar member and in the preferred embodiment is a three-sided, cross-sectionally U-shaped beam having a plurality of relatively large circular apertures in its front side and a plurality of equally spaced, smaller apertures on each of its other sides.

At least one striking-pad plate is mounted on the standard and each such plate is used to mount a striking pad to the standard. The striking-pad plate has a front side with a fitting for receiving a flexible member, a first flange for being positioned along the first lateral side of the standard, and a second flange for being positioned along the second lateral side of the standard. In the preferred embodiment, the first and second flanges each have a plurality of apertures and the striking-pad plate is sized and shaped so that it fits snugly around the standard. A substantially U-shaped pin having first and second prongs is inserted through the apertures in one of the flanges and into the apertures of one of the lateral sides of the standard in order to secure the striking-pad plate at a vertical position along the longitudinal axis of the standard.

A flexible member such as a piece of rubber tubing or other flexible pipe is mounted on the fitting of the striking-pad plate. The flexible member supports a striking pad which has a central bore with a fabric collar around the top of the central bore. The fabric collar has several tabs and each tab has a fastener which is used to help secure the striking pad in place. The striking pad is slid over the flexible member and secured by a square-shaped rim pad which is coupled to the tabs on the fabric collar.

In order to protect the user and reduce the impact of any contact that the user might inadvertently make with the components other than the striking pad, ample padding and cushioning is mounted on the standard and striking-pad plate. An elongated pad assembly having first and second, longitudinally-positioned cushions is mounted on the standard by a plurality of straps and protective pads. An opening is positioned between the first and second cushions and the first side of the standard is accessible therethrough. One or more protective pads are mounted on the standard between the first and second, longitudinally-positioned cushions in order to fix the elongated pad assembly on the standard and protect a user from contact with the standard. The square-shaped rim pads protect the user by covering the striking-pad plate.

One of the useful features of the device is that numerous striking pads may be mounted on it. The standard can accommodate many striking-pad plates and each individual plate can be positioned at a variety of heights along the standard by moving it to a desired location aligned with an aperture in the lateral sides of the standard and securing it in place with a pin. Once the desired number of striking-pad plates are mounted on the standard, the elongated pad assembly is mounted along it so as to cover the two lateral sides of the standard and one or more protective pads are positioned so as to cover any exposed areas of the front side of the standard and secure the elongated pad assembly in place. Other features and advantages of the present invention will become apparent by reference to the detailed description of the invention taken together with the accompanying drawings.

DETAILED DESCRIPTION

Figure 1:
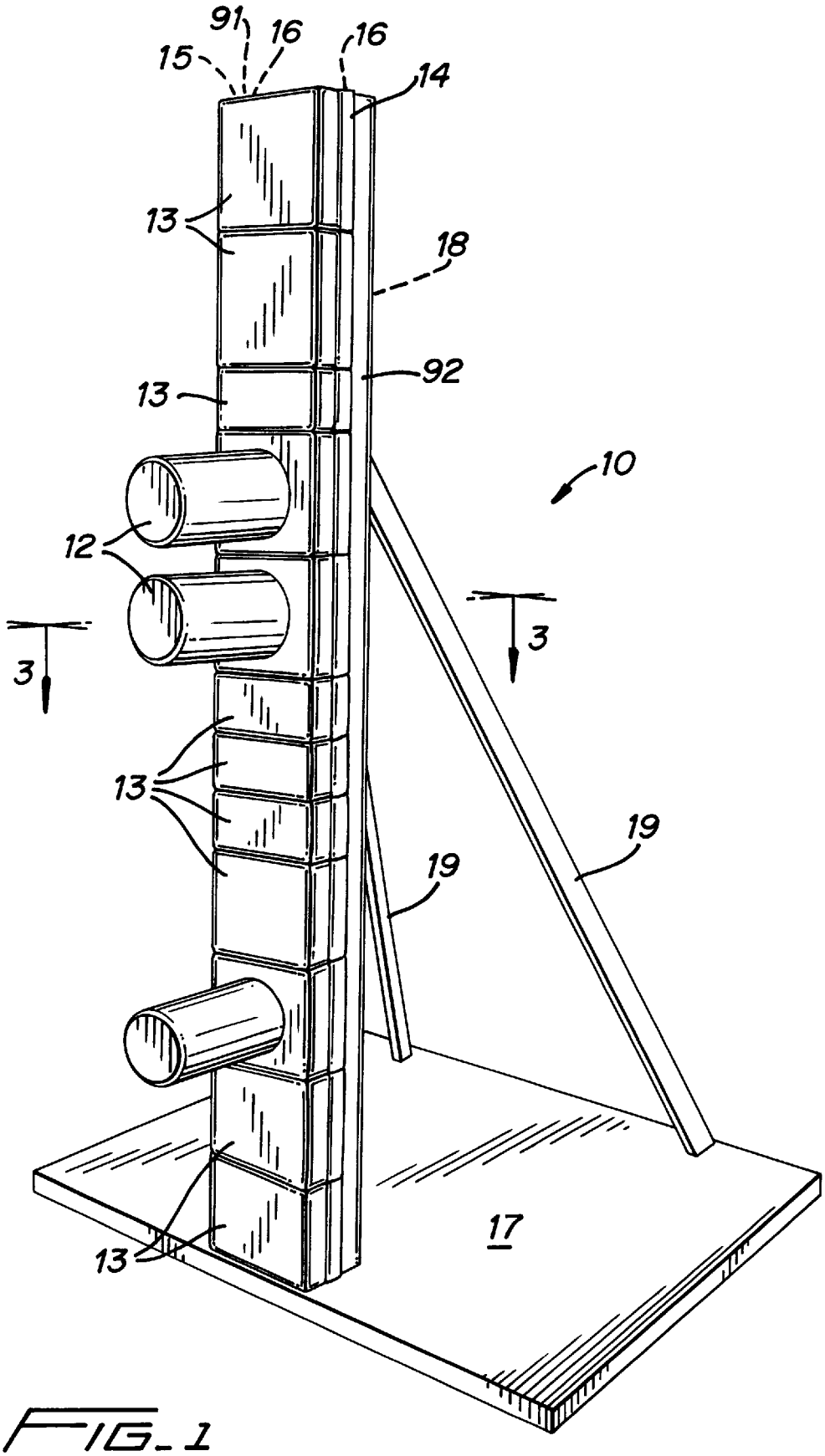
FIG. 1 is a perspective view of a martial arts device designed in accordance with the teachings of the present invention showing the striking pads in a first configuration.
Figure 1A:
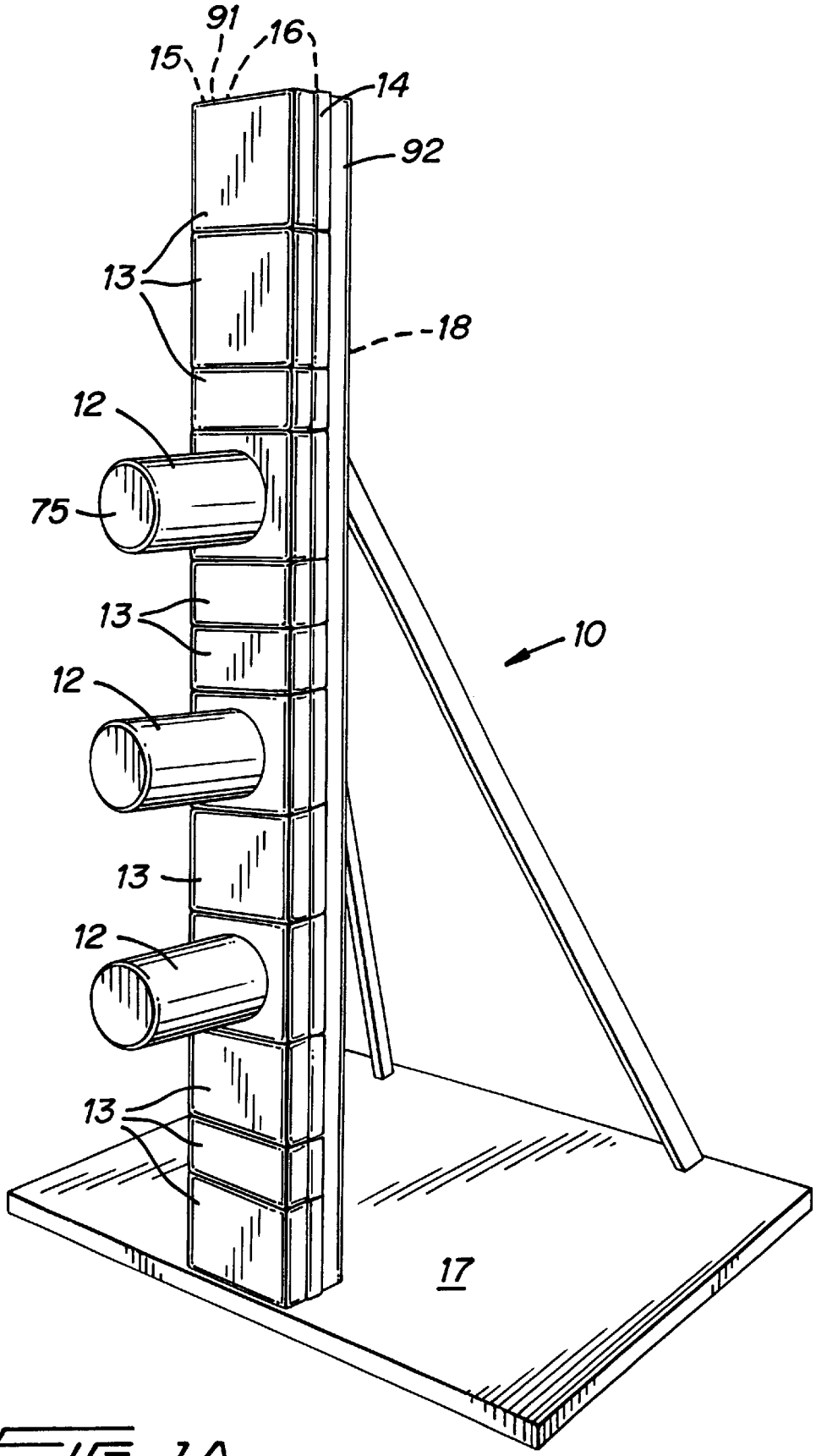
FIG. 1A is a perspective view of the martial arts device of FIG. 1 with the striking pads positioned in a second configuration.

A martial arts practice device 10 in accordance with the present invention is shown in FIG. 1. The martial arts practice device 10 is designed for use in studios, gymnasiums, and other practice centers to help teach and train individuals in martial arts. The device includes a number of striking pads 12 and protective pads 13 with two tabs 14 and 15 each with a fastening means 16 mounted on it. The device 10 uses a modular design (described more fully below) that permits the striking pads 12 and protective pads 13 to be positioned in a variety of positions and, therefore, the striking pads 12 may be configured in various manners (two of which are shown in FIGS. 1 and 1A) so as to facilitate the practice of various martial arts movements.

Figure 2:
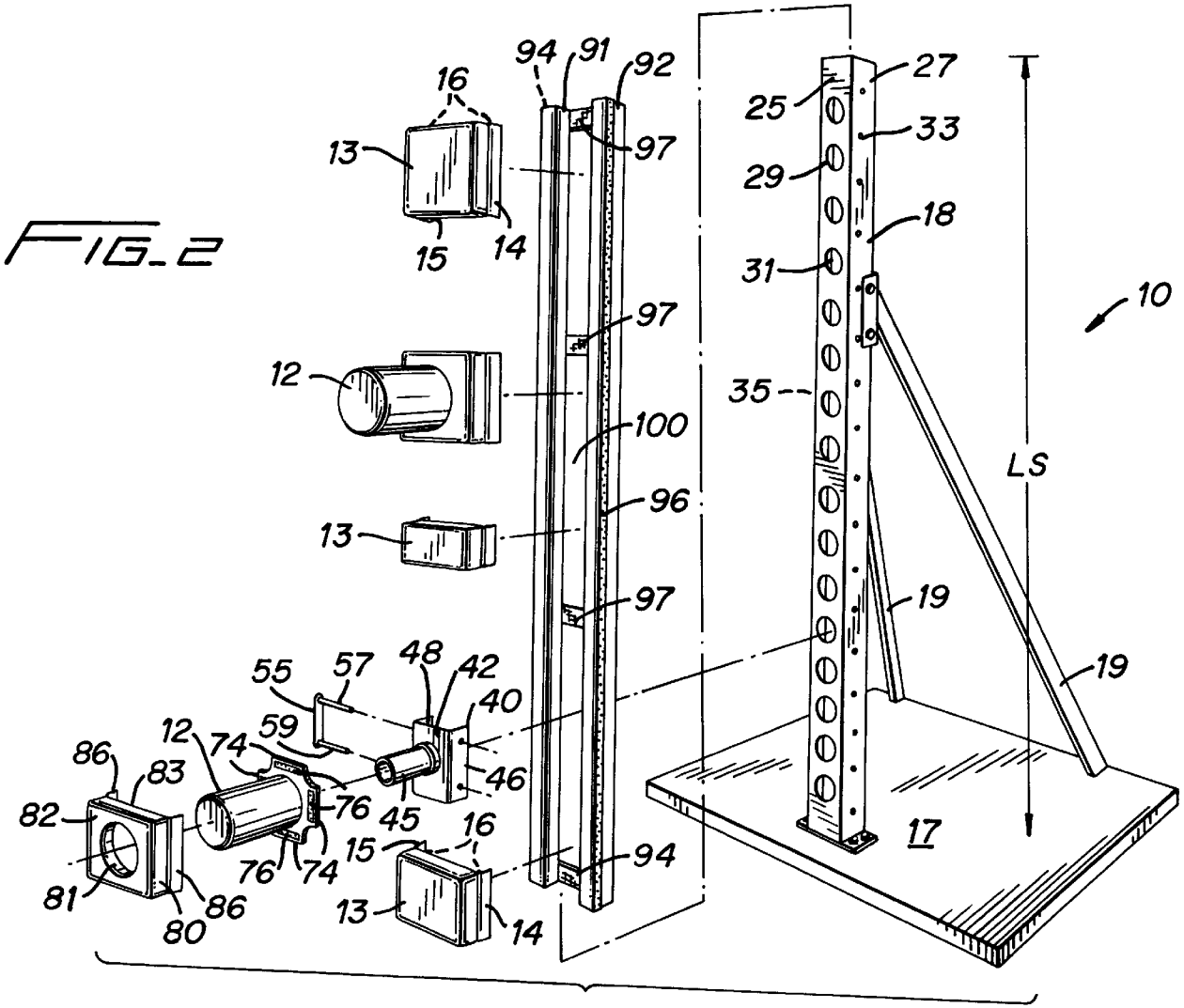
FIG. 2 is an exploded view of the present invention illustrating the mounting of various components to the standard.

As best seen by reference to FIG. 2, the practice device 10 includes a base plate 17 which is designed to rest on a supporting surface such as a floor. A stanchion or standard 18 is mounted on the base plate 17 and supported in a substantially vertical position by a number of braces 19 which are positioned with one of their ends on the standard 18 and the other end on the base plate 17. The base plate 17 and braces 19 are one means for supporting the standard 18 in a substantially vertical position, but a number of difference braces, supports, and other mechanisms could be used to position the standard in a vertical position and would be known to those skilled in the art.

The standard 18 may be any post, beam, tube, or similar member with sufficient strength and rigidity to support the weight of the pads and cushions placed on it and withstand the forces transferred to it through the striking pads and members that support the striking pads. Preferably, the standard is a three-sided, cross-sectionally U-shaped beam made from metal and has a front side 25, a first lateral side 27, a second lateral side 29, and a length LS. The front side 25 may have a plurality of relatively large circular apertures 31 and the first lateral side 27 may have a plurality of equally spaced, apertures 33. Similarly, the second lateral side 29 may have a plurality of equally spaced, apertures 35.

Figure 2A:
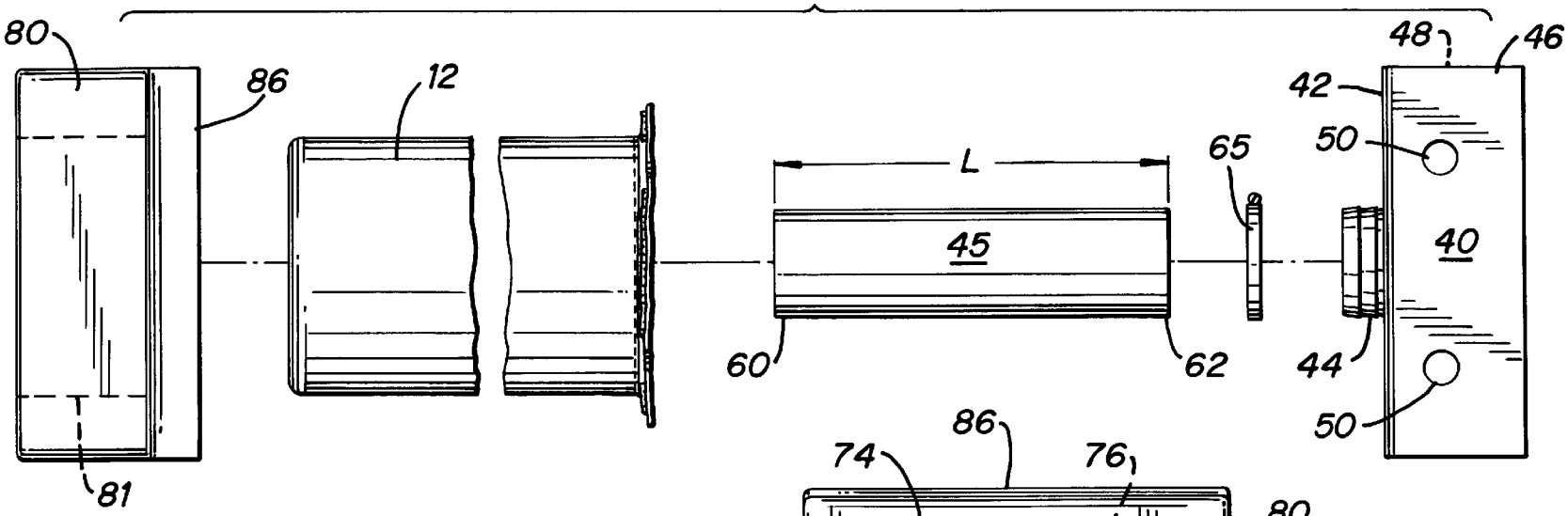
FIG. 2A is an exploded view of a rim pad, striking pad, flexible member, and striking-pad plate illustrating how each of the components are arranged with respect to one another.

As best seen by reference to FIGS. 2 and 2A, the device 10 includes one or more striking-pad plates 40 which are designed to be mounted on the standard 18. Each striking-pad plate 40 is used to mount one striking pad 12 to the standard 18 and has a front side 42 with a fitting 44 for receiving a flexible member 45, a first flange 46 for being positioned along the first lateral side 27 of the standard 18 and a second flange 48 for being positioned along the second lateral side of the standard 18. In the preferred embodiment, the first and second flanges 46 and 48 each have a plurality of apertures 50 and the striking-pad plate 40 is sized and shaped so that it fits snugly around the standard 18. In order to secure the striking-pad plate 40 at a vertical position along the longitudinal axis of standard 18, a substantially U-shaped pin 55 having first and second prongs 57 and 59 is inserted through two of the apertures 50 in one of the flanges 46, 48 and into the apertures 33, 35 in one of the lateral sides 27, 29 of the standard 18.

Figure 4:
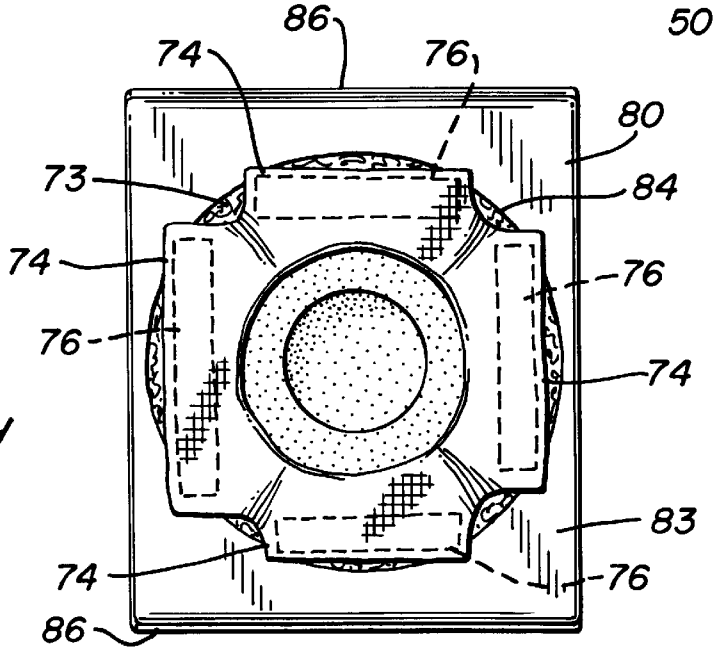
FIG. 4 is an elevational view of the open end of a striking pad illustrating the fabric collar of each striking pad.
Figure 3:
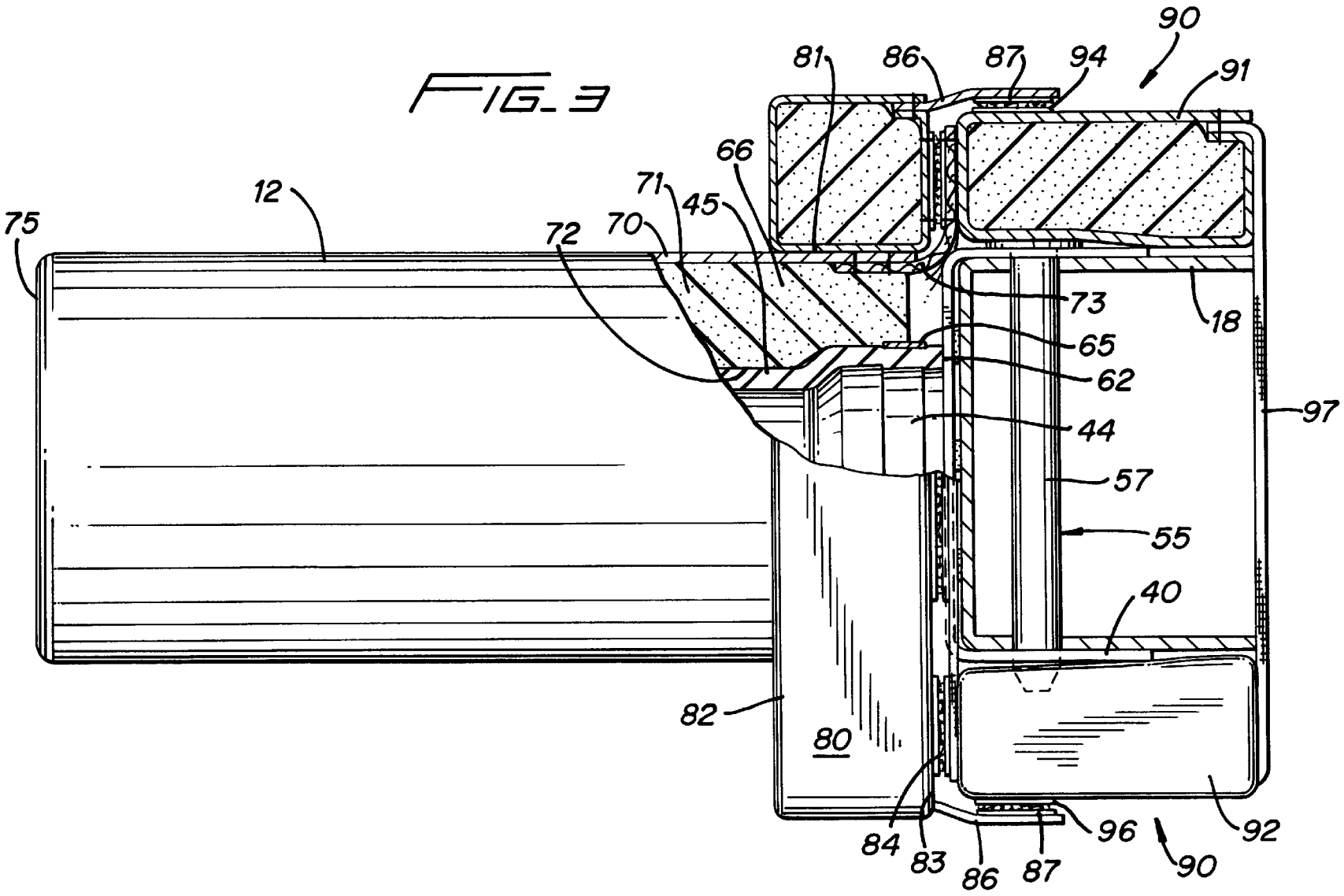
FIG. 3 is a partial, cut-away and cross-sectional view of a striking pad mounted on a striking-pad plate taken along the line 3—3 of FIG. 1 showing the striking-pad plate secured to the standard by a pin.

The flexible member 45 has a first end 60 and a second end 62 and is preferably a piece of rubber tubing or other flexible pipe with a length dimension L which is at least about 70% and as long as about 100% of the length dimension of the striking pad 12 it supports. The flexible member 45 is mounted on the fitting 44 of the striking-pad base plate 46 by means of a clamp 65. Preferably, the second end 62 of the flexible member 45 is sufficiently pliable so that it slightly deforms to form a coupling 66 (FIG. 3) which fits snugly around the fitting 44. The flexible member 45 supports one striking pad 12. Each striking pad 12 has an outer protective cover 70, a ring-shaped layer of cushioning material 71, a central bore 72, a fabric collar 73 with four tabs 74 (FIG. 4), and an outer end 75. Each tab has a fastening means 76 mounted on it. Like all the fastening means used on the pads and cushions in the present invention, the fastening means 76 is preferably a hook and pile fastener such as a Velcro strip. The striking pad 12 is slid over the flexible member 45 and is secured in place by a rim pad 80. Each rim pad 80 has a central opening 81, a first side 82, and a second side 83. A ring-shaped fastening means 84 is positioned on the second side 83 around the peripheral edge of the central opening 81. Two flaps 86 extend from the second side 83 and each has a fastening means 87.

The protective pads 13, rim pads 80, and other pads (discussed below) work in conjunction with one another in order to 1) secure each other in place and 2) protect the user by reducing the impact of any contact that the user might inadvertently make with components other than the striking pads 12, such as the standard 18. Ample padding and cushioning is mounted on the standard 18 and each striking-pad plate 40. As best seen in FIG. 2, an elongated pad assembly 90 having first and second, longitudinally-positioned cushions 91 and 92 is mounted on the standard by a plurality of straps (discussed below) and the protective pads 13. The cushion 91 extends substantially the entire length LS of the standard 18 and has a fastening means 94. Similarly, the cushion 92 extends the entire length LS of the standard 18 and has a fastening means 96. A plurality of straps 97 connect the cushions 91 and 92 to each other.

The elongated pad assembly 90 is positioned on the standard 18 so that the cushions 91 and 92 individually cover the first and second lateral sides 27 and 29. The elongated pad 90 is positioned so as to create an opening 100 through which the front side 25 of the standard 18 is accessible. The elongated pad assembly 90 is secured in place by one or more protective pads 13 by securing the tabs 14 and 15 to the fastening means 96 and 94, respectively.

ASSEMBLY AND USE

One of the useful features of the device 10 is that numerous striking pads 13 may be mounted on it. The standard 18 can accommodate many striking-pad plates 40 and each individual plate 40 can be positioned at a variety of heights along the standard 18 by moving it to a desired location aligned with the apertures 33, 35 in the lateral sides 27, 29 of the standard 18 and securing the striking-pad plate 40 in place with one pin 55. Once the desired number of striking-pad plates are mounted on the standard 18, the elongated pad is mounted along it so as to cover the two lateral sides 27, 29 of the standard 18 and one or more protective pads 13 are positioned so as to cover any exposed areas of the front side the standard 18 and secure the elongated pad assembly 90 in place. Specifically, the tabs 14 and 15 of each pad 13 are secured to the fastening means 96 and 94, respectively.

One flexible member 45 may be mounted on the fitting 44 of each striking-pad base plate 40. A striking pad 12 is then fitted with a rim pad 80 by sliding the rim pad 80 over the striking pad 12 until the fasteners 76 on the tabs 74 are secured to the ring-shaped fastening means 84. The assembly is then slid over the flexible member 45 and secured in place by the tabs 86 which are fixed to the fastening means 94 and 96.

Once assembled, the striking pads 12 may be struck by an individual. Each time one of the striking pads 12 is hit, its outer end 75 moves and the resilience of the flexible member 45 causes the striking pad to return to its original position.

The protective pads 13 may be variable sizes and as shown in FIGS. 1 and 1A it is preferable that there be two sizes of protective pads—a large size and a small size having half the height of the large size. The design of the device 10 is such that the striking-pad plates 40 and protective pads 13 have similar dimensions and, thus, may be substituted for one another to allow relatively easy substitution of a striking-pad plate 40 with a striking pad 12 for a protective pad 13.

From the foregoing it can be seen that the present invention offers a modular design where components can be substituted for one another so as to permit a variety of striking pad orientations to be created. Further, the device has relatively few components and is simple in overall design. Further still, the present invention employs a novel system of inter-fastened pads which secure components of the invention on the standard and fully cover those areas which a person might strike while practicing martial arts movements, thereby protecting the user from injury which might occur from striking an un-padded surface.

While the present invention has been described in what is believed to be the most preferred form, it is to be understood that the invention is not confined to the particular construction and arrangement of the components herein illustrated and described, but embraces such modified forms thereof as come within the scope of the appended claims.

What is claimed is:

1. A martial arts practice device comprising:

a standard having a first side;

means for supporting the, standard in a substantially vertical position;

at least one striking-pad plate mounted on the standard;

an elongated pad assembly for being mounted on the standard, the elongated pad assembly having first and second, longitudinally-positioned cushions and defining an opening positioned between the first and second cushions, through which the first side of the standard is accessible;

a flexible member mounted to the at least one striking-pad plate;

a striking pad having a bore for receiving the flexible member; and a rim pad fastened to the striking pad;

wherein the rim pad is fastened to the elongated pad assembly and secures the striking pad in place over the flexible member.

2. A martial arts practice device as in claim 1, wherein the first and second longitudinally-positioned cushions each have a fastening means and the rim pad has first and second tabs, and the first tab is fastened to the fastening means on the first cushion and the second tab is fastened to the fastening means on the second cushion.

3. A martial arts practice device as in claim 2, wherein the striking pad has a collar and the rim pad has a ring-shaped fastener and the collar is fastened to the ring-shaped fastener.

4. A martial arts practice device as in claim 3, wherein the first and second longitudinally-positioned cushions are connected to each other by a plurality of straps.

5. A martial arts practice device as in claim 3, wherein the flexible member is a rubber tube.

6. A martial arts practice device as in claim 1, further comprising a plurality of protective pads for covering the front side of the standard, each protective pad fastened to the elongated pad assembly.

7. A martial arts practice device as in claim 6, wherein the protective pads are of two different sizes.

8. A martial arts practice device as in claim 7, wherein each protective pad has a plurality of tabs and each tab has a fastening means thereon.

9. A martial arts practice device as in claim 8, wherein each of the tabs are fastened to the elongated pad assembly.

10. A martial arts practice device comprising:

a standard having a first side;

means for supporting the standard in a substantially vertical position;

at least one striking-pad plate mounted on the standard;

a flexible member mounted to the at least one striking-pad plate;

an elongated pad assembly for being mounted on the standard, the elongated pad assembly having first and second, longitudinally-positioned cushions and defining an opening positioned between the first and second cushions, through which the first side of the standard is accessible, the first and second cushions each having a fastening means;

a striking pad having a bore for receiving the flexible member; and a rim pad fastened to the striking pad, the rim pad having first and second tabs, each with a fastening means;

wherein the first tab of the rim pad is fastened to first cushion of the elongated pad assembly and the second tab is fastened to the second cushion of the elongated pad assembly, thereby securing the striking pad in place over the flexible member.

11. A martial arts practice device as in claim 10, wherein the striking pad has a collar and the rim pad has a ring-shaped fastener and the collar is fastened to the ring-shaped fastener.

12. A martial arts practice device as in claim 10, wherein the first and second longitudinally-positioned cushions are connected to each other by a plurality of straps.

13. A martial arts practice device as in claim 10, wherein the flexible member is a rubber tube.

14. A martial arts practice device as in claim 10, further comprising a plurality of protective pads for covering the front side of the standard, each protective pad fastened to the elongated pad assembly.

15. A martial arts practice device as in claim 14, wherein the protective pads are of two different sizes.

16. A martial arts practice device as in claim 15, wherein each protective pad has a plurality of tabs and each tab has a fastening means thereon.

17. A martial arts practice device as in claim 16, wherein each of the tabs are fastened to the elongated pad assembly.

18. A martial arts practice device comprising:

a standard having a front side, a first lateral side, and second lateral side with a plurality of apertures;

means for supporting the standard in a substantially vertical position;

at least one striking-pad plate mounted on the standard, the striking-pad plate having a first side with a fitting for receiving a flexible member, a first flange for being positioned along the first lateral side of the standard and a second flange for being positioned along the second lateral side of the standard, the first and second flanges having a plurality of apertures;

a pin having a first and second prongs, the prongs for being inserted through the apertures in the first and second flanges and into the apertures in the first and second lateral sides of the standard in order to secure the striking-pad plate at a vertical position along the second side of the standard;

an elongated pad assembly for being mounted on the standard, the elongated pad assembly having first and second, longitudinally-positioned cushions and an opening positioned between the first and second cushions through which the first side of the standard is accessible;

a flexible member mounted to the fitting;

a striking pad having a bore for receiving the flexible member;

a square-shaped pad for being positioned around the fitting of the striking-pad base plate; and one or more protective pads for being mounted on the standard between the first and second, longitudinally-positioned cushions in order to protect a user from contact with the standard.

* * * * *